United States Patent [19]

de Jager

[11] 4,353,786

[45] Oct. 12, 1982

[54] ELECTROLYTIC SILVER TARNISH REMOVAL METHOD

[75] Inventor: Jan de Jager, DE Meern, Netherlands

[73] Assignee: S. C. Johnson & Son, Inc., Racine, Wis.

[21] Appl. No.: 276,390

[22] Filed: Jun. 22, 1981

[51] Int. Cl.[3] ..... C25F 1/00

[52] U.S. Cl. ..... 204/144

[58] Field of Search ..... 204/140, 144

[56] References Cited

U.S. PATENT DOCUMENTS 937,154 10/1909 Keyt ..... 204/144

2,801,961 8/1957 Treece ..... 204/144

*Primary Examiner*—T. Tufariello

[57] ABSTRACT

An improved method of removing tarnish from silver using an electrolytic cell containing water, sodium sulfite and sodium carbonate.

5 Claims, No Drawings

ELECTROLYTIC SILVER TARNISH REMOVAL METHOD

BACKGROUND OF THE INVENTION

This invention relates to a method of removing tarnish from silver objects using an electrolytic method. More particularly, this invention relates to the use of an improved electrolytic solution for removing silver tarnish.

In the past it has been known to utilize soda ash as an electrolyte in an aqueous medium for removing silver tarnish. This prior method includes dissolving the soda ash in water at a relatively high temperature, placing a suitable anode, such as an aluminum sheet, in the soda ash solution and contacting the silver to be cleaned with both the solution and the anode. Although this method of removing silver tarnish is acceptable at elevated temperatures, it has been found desirable to provide a composition which will quickly and efficiently remove tarnish build up from silver articles at a below room temperature so that no external heat is necessary. Although this is not particularly critical for individual household consumer, the requirements of keeping institutional systems heated can result in a substantial expenditure of energy.

BRIEF DESCRIPTION OF THE INVENTION

It has now been surprisingly found that the incorporation of a small percentage of sodium sulfite into the electrolytic solution surprisingly improves the speed at which a sodium carbonate electrolytic solution can remove the silver sulfide from silver articles. It has also been found that in a preferred embodiment of the present invention, that the incorporation of a small percentage of sodium citrate vastly improves the efficiency of the electrolyte system in removing silver sulfide.

OBJECTS AND ADVANTAGES

It is therefore the primary object of the present invention to provide an improved method for removing silver sulfide from silver articles by an electrolytic process.

It is a further object of the present invention to provide an improved method for removing silver sulfide from silver articles by incorporating into the electrolytic solution a small percentage of sodium sulfite.

It is a still further object of the present invention to provide an improved electrolytic method for removing silver sulfide tarnish at temperatures below room temperature.

Still further objects and advantages of the method of the present invention will become more apparent from the following, more detailed, description thereof.

DETAILED DESCRIPTION OF THE INVENTION

The present invention is directed to an improved method for removing silver sulfide from silver articles comprising forming a solution comprising 1.4 to 5.0% of sodium carbonate, 0 to 3.0% of a nonionic surfactant, and water; the solution having a pH of greater than 10; contacting the solution with an aluminum anode; and contacting the silver articles to be cleaned with the anode and the solution to form an electrolytic cell, the improvement which comprises incorporating from 0.6 to 2.5% by weight of sodium sulfite into the solution.

When used in the instant specification and claims, the term "silver articles" shall mean articles having a surface primarily of silver, including pure silver, sterling silver and silver plate.

In the method of the present invention, it is important to be able to form an electrolytic solution including a certain amount of electrolyte. The solution should contain from 1.4 to 5% by weight sodium carbonate. The sodium carbonate dissociates into the solution, to form sodium and carbonate ions. This electrolytic solution allows current to pass from the aluminum anode to the silver cathode when the aluminum and silver articles are brought in contact. As a result of this current, the silver sulfide is reduced to metallic silver. The solution used in the method of the present invention should contain 1.4 to 5% sodium carbonate, and preferably should contain from 2 to 4% by weight sodium carbonate.

The second critical component of the electrolytic solution of the present invention is the sodium sulfite. Sodium sulfite is a reducing agent, and aids in the formation of silver cations from the silver sulfide. A great number of reducing agents have been tried and was surprisingly found that only sodium sulfite seems to have any positive effect upon the speed and activity of the silver detarnishing electrolytic cell. It has been found that there is a critical ratio of sodium carbonate to sodium sulfite in that the ratio of sodium carbonate to sodium sulfite must be within the range of 80/20 to 50/50, and it is most preferred that this ratio be within the range of from 75/25 to 60/40 weight percentages. It has been found that compositions containing from 0.6 to 2.5% by weight sodium sulfite combined with an appropriate amount of sodium carbonate perform well both at low and high temperatures to remove silver sulfide from silver articles.

The solution utilized in the method of the present invention may also contain a number of optional ingredients. The most important optional ingredient is sodium citrate. Sodium citrate is important, in that it aids in the tarnish removal process by providing bite or activity to the composition to remove tarnish which has aged substantially. This aids in removing surface oils, and other barriers which may prevent the formation of the electrolytic cell, and allows the solution to electrolytically remove the silver sulfide in the method of the present invention. Generally from 0 to 2% by weight of the solution of sodium citrate should be present, and it is preferred that 0.5 to 1.5% sodium citrate be utilized.

A second optional ingredient is a nonionic surfactant. Nonionic surfactants further aid in the wetting of the surface of the silver article to be cleaned. These nonionic surfactants also aid in penetrating any barriers of dirt and other materials which may be present on the surface of the silver article, in addition to the silver sulfide. Generally, it has been found that from 0 to 3% by weight of a nonionic surfactant can be utilized. The particular nonionic surfactant is not critical and can be chosen from any of a large number of well-known and commercially available nonionic surfactants. Classes of nonionic surfactants include the ethoxylated alkyl aryl compounds such as the ethoxylated nonyl and octyl phenols, as well as the ethoxylated linear alcohols such as the ethoxylated lauryl alcohol series. A particularly preferred nonionic surfactant is the ethoxylate of 9 moles of ethylene oxide reacted with a $C_{12}$–$C_{15}$ alkyl alcohol mixture.

The solution used in the present method also may include a small percentage of chelating agent. Generally, this percentage is from 0 to 1% by weight based on the weight of the solution of a chelating agent. Again, the choice of a particular chelating agent is not critical, and any number of chelating agents, such as sodium EDTA and NTA can be utilized as a component of the solution in the method of the present invention.

If the method of the present invention is intended to be practiced by the consumer as a household product, the method may be most conveniently be practiced by packaging the components to be dissolved to form the solution in an aluminum foil pouch, dissolving the contents of the pouch in an appropriate amount of water to form the solution and placing the pouch in the solution. At this point the silver article to be cleaned is then contacted both with the aluminum foil pouch and the solution to create the electrolytic cell.

The solution used in the method of the present invention should have a pH above pH 10. It has been found that a pH below the range does not adequately clean or remove the silver sulfide tarnish from silver articles. Also, the temperature of the solution should be at a temperature greater than 5° C. As noted previously, it is at lower temperatures, i.e. temperatures of 5° to 20° C. that the improved method of the present invention is most advantageous, as at these lower temperatures the speed of the electrolytic cell is greatly improved.

The solution of the present invention also may include as an option ingredient, a small percentage of a silver tarnish inhibiting agent, such as 2-mercaptobenzothiazole, and thiosemicarbazide. It has been surprisingly found that the incorporation of these components into the electrolytic cell, does not inhibit the electrolytic removal of the silver sulfide tarnish, and also surprisingly does not interfere with the inhibition properties of these materials.

The method of the present invention will now be more fully illustrated by the following examples, which are for the purposes of illustration only, and in no way considered as limiting. In the following examples, all the parts and percentages are by weight, and all temperatures in degrees centigrade.

EXAMPLE 1-5

The compositions set forth in Table I were prepared by mixing the ingredients.

TABLE I

| Component | Examples 1 | 2 | 3 | 4 | 5 |
|---|---|---|---|---|---|
| Sodium Carbonate | 58.0 | 59.0 | 59.0 | 56.5 | 56.5 |
| Sodium Sulfite | 35.0 | 35.0 | 20.0 | 20.0 | 20.0 |
| EDTA - $Na_2$ | 4.0 | 4.0 | 4.0 | 4.0 | 4.0 |
| Sodium Citrate | — | — | 15.0 | 14.0 | 14.0 |
| 2-Mercaptobenzothiazole | — | — | — | 3.5 | — |
| Thiosemicarbazide | — | — | — | — | 3.5 |
| Triton N101[1] | 3.0 | — | — | — | — |

TABLE I-continued

| Component | Examples 1 | 2 | 3 | 4 | 5 |
|---|---|---|---|---|---|
| Surfonic N120[2] | — | 2.0 | — | — | — |
| Neodol 25-9[3] | — | — | 2.0 | 2.0 | 2.0 |

[1]Triton N101 - Nonyl phenoxy polyethoxy ethanol (9-10 EO); Rohn & Haas Co.
[2]Surfonic N120 - Nonyl phenoxy polyethoxy ethanol (12 EO); Jefferson Chemical Co.
[3]Neodol 25-9 - $C_{12}$-$C_{15}$ linear primary alcohol ethoxylate (9 EO); Shell Chemical Co.

Each composition is dissolved in sufficient water to make a 3% solution. An aluminum foil sheet is placed in the container and the tarnished silver is added. In each case the silver was cleaned.

No silver metal is lost by using this cleaning method because the silver sulfide is reduced to metallic silver and hydrogen sulfide.

EXAMPLE 5 AND COMPARATIVE EXAMPLE 1

In order to show the effect of temperature in the cleaning of the composition of the present invention a 70/30 mixture of sodium carbonate and sodium sulfite were dissolved to form a 2% solution. A 2% solution of sodium carbonate was used as Comparative Example 1. The solutions were cooled to the temperatures set forth in Table II.

TABLE II

| Run | Temp. 5° | 10° | 15° | 20° | 25° | 30° |
|---|---|---|---|---|---|---|
| Comp. Ex. 1 | 20 | 13 | 6.5 | 3 | 2 | 1 |
| Example 5 | 16 | 11 | 5.5 | 3 | 2 | 1 |

In each case an aluminum foil anode was placed in the solution in contact with the silver plate. The tarnish was created by exposing the silver plate to a high concentration of atmospheric hydrogen sulfide until a deep golden-brown color had developed. The value shown in Table II is the time in minutes for the silver to be cleaned. This shows the advantage of the present invention at low temperatures.

I claim:

1. A method of removing silver sulfide from silver articles comprising forming a solution comprising 1.4 to 5.0% of sodium carbonate, 0 to 3.0% of a nonionic surfactant and water; the solution having a pH of greater than 10; contacting the solution with an aluminum anode; and contacting the silver articles to be cleaned with both the anode and the solution to form an electrolyte cell; the improvement which comprises incorporating from 0.6 to 2.5% by weight of sodium sulfite into the solution.

2. The method of claim 1 wherein the solution includes 0.5 to 1.5% sodium citrate.

3. The method of claim 1 wherein the solution includes an effective amount of a tarnish retarding agent.

4. The method of claim 1 wherein the sodium carbonate and sodium sulfite are present in a ratio of 80:20 to 50:50.

5. The method of claim 1 wherein the solution contains from 2 to 4% by weight sodium carbonate.

* * * * *